United States Patent [19]

Agcaoili

[11] 4,104,829

[45] Aug. 8, 1978

[54] ROLLER AND HANGER ASSEMBLY FOR BY-PASS DOORS

[75] Inventor: Clarito R. Agcaoili, Glendale Heights, Ill.

[73] Assignee: United States Gypsum Company, Chicago, Ill.

[21] Appl. No.: 801,720

[22] Filed: May 31, 1977

[51] Int. Cl.[2] ..... E05D 13/02

[52] U.S. Cl. ..... 49/409; 16/105; 49/425

[58] Field of Search ..... 49/409, 410, 411, 412, 49/125, 425; 16/105, 87 R

[56] References Cited

U.S. PATENT DOCUMENTS

| | | | |
|---|---|---|---|
| 629,165 | 7/1899 | Larson | 49/409 X |
| 2,610,367 | 9/1952 | Nordahl | 49/411 |
| 2,784,445 | 3/1957 | Greig et al. | 49/410 X |
| 3,111,209 | 11/1963 | Riegelman | 49/425 |
| 3,172,145 | 3/1965 | Miller | 49/409 X |
| 3,281,993 | 11/1966 | Riegelman | 49/425 |

*Primary Examiner*—Philip C. Kannan

*Attorney, Agent, or Firm*—Samuel Kurlandsky; Robert H. Robinson; Kenneth E. Roberts

[57] ABSTRACT

A structure comprising by-pass doors each having a frame and a panel mounted within the frame, the doors being suspended from a track by means of hangers each having a roller pivotally mounted at one end thereof supported and guided on a track, the hanger comprising a mounting shank engaged in a channel of the door frame with an elongate slot provided in the shank having a screw disposed within the slot and engaged in an aperture provided in the door frame, thereby adjustably securing the hanger to the door frame.

1 Claim, 4 Drawing Figures

ROLLER AND HANGER ASSEMBLY FOR BY-PASS DOORS

BACKGROUND OF THE INVENTION

1. Field of the Invention

The present invention relates to structures for mounting slidable doors on rails for movement thereon, and more particularly refers to a structure wherein the elevation of the doors may be readily adjusted to compensate for out-of-plumb installations without the necessity for disassembly of the door and rail structure.

2. Description of the Prior Art

By-pass doors generally comprise one or more doors each comprising a frame in which a panel of plastic or glass is mounted. The doors have hangers affixed at the top of each door on which rollers are rotatably mounted and the rollers each engage a track which is fixably mounted. Because the doors must at times be mounted in installations which are out-of-plumb, a provision must be made for adjusting the elevation of the doors with respect to the installation. This has conventionally been accomplished in one of several ways. In one structure a portion of the frame on which the hanger is mounted is provided with a series of holes at varying elevations from the edge of the panel. In another structure an elongate slot is positioned at an acute angle with respect to the longitudinal direction of the frame member in which it is provided to permit the fastener for the hanger to be affixed at various elevations. However, the prior structures require the door assembly to be taken out from the header track or rail or in some case even disassembled in order to perform the adjustment.

SUMMARY OF THE INVENTION

It is therefore an important object of the present invention to provide a structure for by-pass door panel assemblies which may be adjusted to accommodate for out-of-plumb installations.

It is a further object to provide a structure wherein an adjustment in door elevation may be made without the necessity for disassembling the door from the header track or rail.

It is still further an object to provide a mounting structure which is relatively inexpensive and simple to produce.

These and other objects, advantages and functions of the invention will be apparent on reference to the specification and to the attached drawings illustrating preferred embodiments of the invention, in which like parts are identified by like reference symbols in each of the views.

DESCRIPTION OF THE PREFERRED EMBODIMENT

Figure 1:
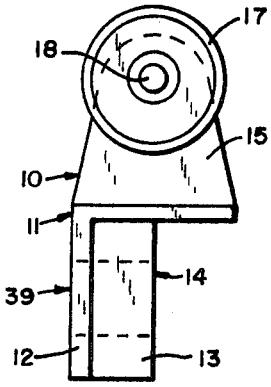
FIG. 1. is a side elevational view of a hanger and roller assembly according to the invention.
Figure 2:
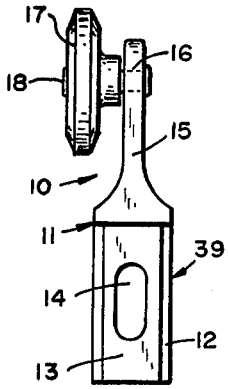
FIG 2 is an end elevational view of the structure shown in FIG. 1.

Referring to FIGS. 1 and 2, a hanger and roller assembly 10 according to the invention is shown comprising a hanger 11 having a shank 39 and a trunnion 15. The shank 39 is recessed to define a flange 12 and a recessed insert member 13. An elongate slot 14 is provided extending through the shank 39. The trunnion 15 is provided with an aperture 16 for mounting a roller 17 by means of a rivet 18 upon which the roller 17 is rotatably mounted, one end of the rivet 18 being affixed within the aperture 16.

Figure 3:
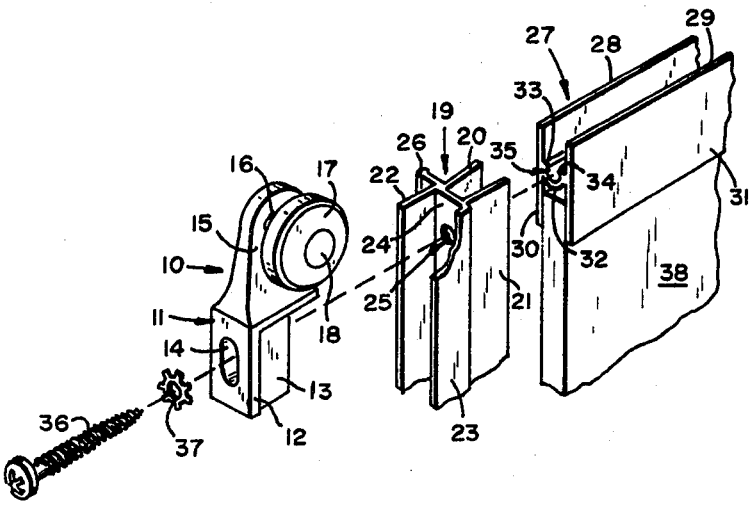
FIG. 3 is an exploded perspective view of the structure in combination with a door frame and panel.

Referring to FIG. 3, an assembly is shown comprising the hanger and roller assembly 10 in combination with a door frame and a door panel. As shown, the assembly comprises a side frame 19 which is H-form in cross-section and which has inner flanges 20 and 21, and outer flanges 22 and 23. A web 24 connects the pairs of flanges 20 and 22 with 21 and 23, and is provided with an aperture 25. A lateral arm or handle 26 is provided on the flanges 20 and 22.

A top frame 27, also of generally H-shape cross-section, is comprised of upper flanges 28 and 29, and lower flanges 30 and 31. An arcuate web 32 connects the flanges on both sides. Protuberances 33 and 34 cooperate with the arcuate web 32 to provide a screw-engaging channel 35. The assembly is held together by means of a screw 36 having an external star washer 37 which engages the screw-engaging channel 35 in self-tapping engagement. A panel 38 is retained between the lower flanges 30 and 31.

Figure 4:
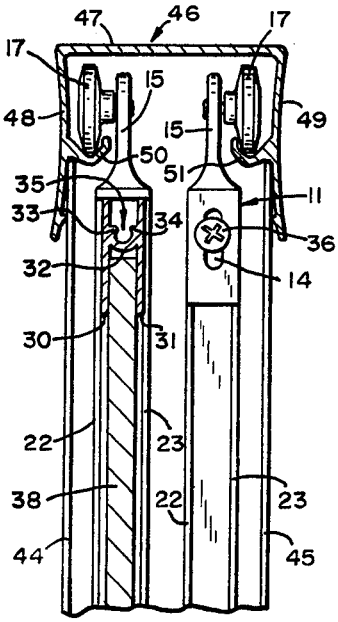
FIG. 4 is an end view, partly in cross section, of an assembly of a pair of doors mounted in an overhead rail structure.

Referring to FIG. 4, a complete structure is shown in which two doors having hanger and roller assemblies according to the invention are mounted in a track assembly. The structure comprises supporting frame members 44 and 45 on which a header track assembly 46 is mounted comprising a base web 47 and flanges 48 and 49. The flanges 48 and 49 are provided with tracks 50 and 51, respectively. A complete panelled door and hanger and roller assembly similar to that shown in FIG. 3 is mounted on each track 50 and 51. It is to be understood that although a hanger and roller assembly is shown only at one end of the door panel in FIG. 4, a similar structure is also mounted at the other end of the door panel. Consequently, each door assembly as shown in FIG. 4 has a hanger and roller assembly at each end.

In assembling each door structure, the frames are positioned at each end as shown in FIG. 3 with panels 38 inserted in the frame member channels. The screw 36 is inserted through the washer 37, through the elongate aperture 14, through the aperture 25 and engaged in the screw-engaging channel 35. The channel 35 is preferably designed to provide self-tapping engagement with the screw 36, although if desired, the channel 35 may be threaded to receive the threads of the screw 36.

After the door assemblies having the hanger and roller assembly of the present invention are assembled, in order to adjust the elevation at each end of each door to compensate for out-of-plumb installations, it is only necessary to loosen the screw 36 at each end of the door. The hanger and roller assembly 10 can then be raised or lowered with respect to the door frame, thereby in effect raising or lowering the level of the door. When the proper repositioning has been accomplished, it is only necessary to tighten the screw 36 and the entire door assembly will then be retained in the proper orientation where it will function in spite of out-of-plumb basic support structures.

Although the doors of the present invention are designed to be used primarily for shower installations, they may be utilized in other applications wherever roller mounted doors are required. The door panels 38 are preferrably of a plastic material, although they alternatively may be made of glass or other sheet-form materials. The frame members may be made of molded or extruded plastics or metals, aluminum being a desirable material. The hanger 11 and roller 17 are preferrably formed of a plastic material such as acetal, Delrin or Celcon, the latter two being registered trademarks. These materials are tough and resilient and have good bearing properties. Alternatively, the parts may be made of various metals.

The hanger and roller assembly of the present invention and the door assemblies which may be constructed therewith have a number of advantages over prior art structures. First and foremost, the structure permits very easy adjustment in elevation of the door panels and frames to compensate for out-of-plumb base supporting structures. The adjustment may be made simply by loosening the screw 36 and readjusting the relative positions of the hanger 11 and the door frame. The structures may then be affixed with respect to each other merely by tightening the screw 36. The screw additionally serves to retain the hanger and roller assembly on the door frame, and also serves to affix the side frame to the top frame. The structure is simple to fabricate and assemble and is made of relatively inexpensive materials.

It is to be understood that the invention is not to be limited to the exact details of construction or operation or materials shown and described, as obvious modifications and equivalents will be apparent to one skilled in the art.

Invention is claimed as follows:

1. A slidable door and support structure comprising in combination:

(a) a supporting structure including a track, (b) a door comprising a frame having a panel engaged therein, (c) a pair of hanger and roller assemblies mounted one at each end of said door, each of said hangers comprising a shank recessed to define an insert member and a flange, said insert member and flange having an elongate slot provided therein and a trunnion at the end thereof having said roller rotatably mounted thereon and each of said rollers engaged by said track, and (d) a retaining screw positioned within the elongate slot of said insert member and flange, and wherein said frame comprises a side frame member H-form in cross-section having a pair of channels one in which said insert member is disposed, the edges of said channel engaging the flange of said shank, and the other channel engaging a panel of said door, wherein said side frame member has an aperture therein to permit said retaining screw to pass therethrough, and wherein said frame further comprises a top frame member provided with a channel for receiving said panel, and is further provided with means defining a screw-engaging channel receiving and engaging said retaining screw in self-tapping engagement, whereby said retaining screw may be loosened to permit said hanger to be raised or lowered with respect to said frame to maintain said hanger and said frame in the proper position in relation to each other.

* * * * *